United States Patent [19]

Granata et al.

[11] 4,264,643

[45] Apr. 28, 1981

[54] METHOD OF IMPROVING THE ADHESION OF POLYURETHANE TO VINYL RESINS

[75] Inventors: Guido J. Granata, Bloomfield; Robert P. Conger, Park Ridge; Peter J. Rohrbacher, Stocton, all of N.J.

[73] Assignee: Congoleum Corporation, Kearny, N.J.

[21] Appl. No.: 82,244

[22] Filed: Oct. 5, 1979

[51] Int. Cl.[3] ..... B05D 3/06

[52] U.S. Cl. ..... 427/44; 156/244.23; 156/308.6; 427/54.1; 427/302; 428/315; 428/424.6

[58] Field of Search ..... 427/316, 44, 299, 53.1, 427/301, 54.1, 302, 307; 156/244.23, 308.6; 428/305, 310, 315, 424.6

[56] References Cited

U.S. PATENT DOCUMENTS

| | | | |
|---|---|---|---|
| 3,293,094 | 12/1966 | Nairn | 156/79 |
| 3,293,108 | 12/1966 | Nairn | 156/79 |
| 3,489,631 | 1/1970 | Chen et al. | 156/244.23 |
| 3,740,252 | 6/1973 | Chaikin | 427/307 |
| 3,813,257 | 5/1974 | West | 427/316 |
| 4,093,686 | 6/1978 | Briston et al. | 427/307 |
| 4,176,210 | 11/1979 | Skinner | 428/315 |
| 4,180,615 | 12/1979 | Bettoli | 428/424.6 |

*Primary Examiner*—John H. Newsome
*Attorney, Agent, or Firm*—Richard T. Laughlin

[57] ABSTRACT

A method of improving the bond between a vinyl resin material and a polyurethane or acrylated polyurethane resin material which comprises coating a fused vinyl resinous layer with an aqueous acetic acid solution, drying the aqueous coating, applying an uncured polyurethane or acrylated polyurethane layer to the coated surface of the vinyl resin material and exposing the vinyl resinous composition layer and the uncured polyurethane or acrylated polyurethane resin layer to curing conditions to develop a strong and permanent bond between the two layers.

8 Claims, 2 Drawing Figures

METHOD OF IMPROVING THE ADHESION OF POLYURETHANE TO VINYL RESINS

THE FIELD OF THE INVENTION

Figure 1:
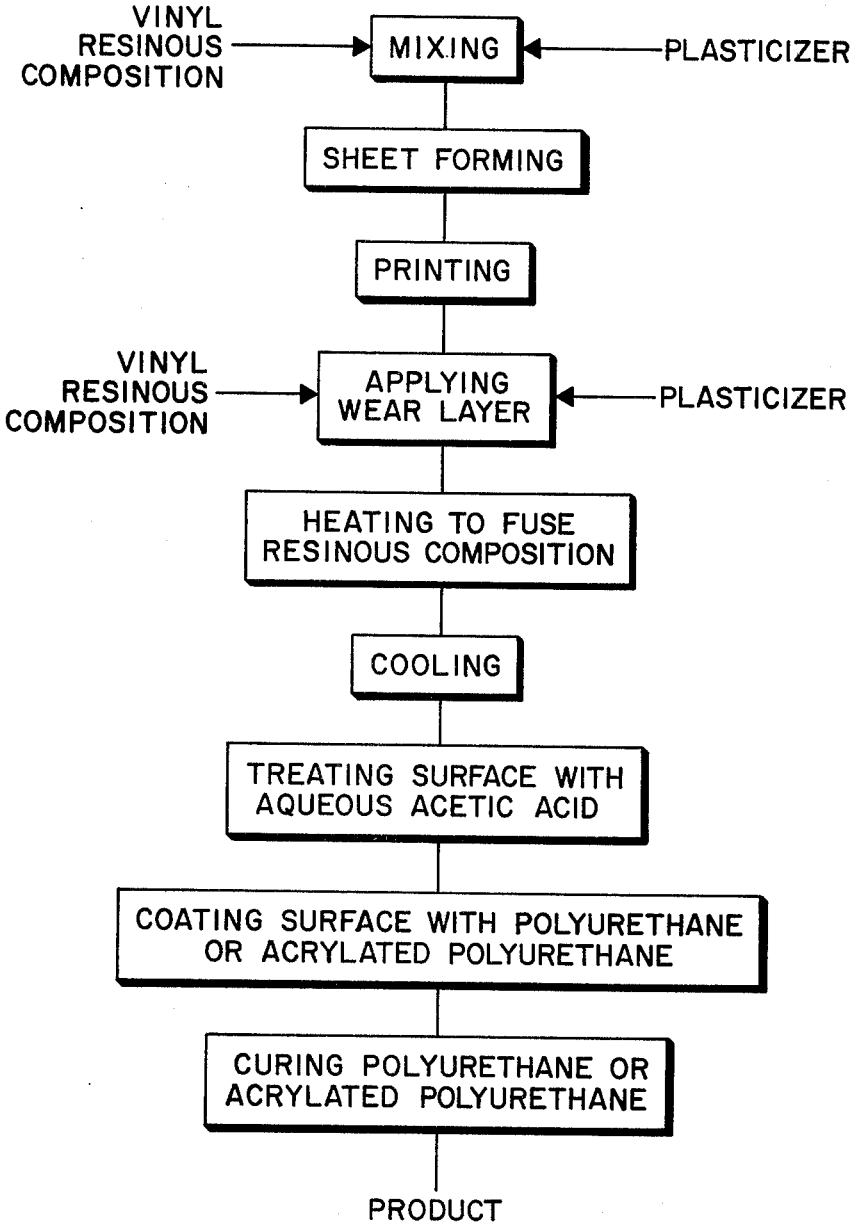

The present invention relates to methods of making multi-layered products, and more particularly multi-layered sheet materials, such as resilient floor coverings, which comprises a vinyl resin layer and a polyurethane or acrylated polyurethane resin layer, wherein it is necessary that such layers be adhered together in a strong and permanent bond which resists delamination.

BACKGROUND OF THE INVENTION

It is well known in the manufacture of multi-layered products, such as resilient floor, wall or ceiling coverings, or resilient desk, table or counter tops, and the like, that it is often necessary to bond together two or more layers of dissimilar synthetic polymeric materials and that it is often difficult to obtain a strong and permanent bond between such dissimilar synthetic materials.

Such difficulties often are believed to arise in the bonding of such dissimilar synthetic polymeric materials because of the differences in surface energies. For example, if atoms from two dissimilar synthetic polymeric materials cannot get close enough to each other, perhaps because of large dissimilarities or disparities in polarity, van der Waals forces cannot be adequately taken advantage of to create strong permanent bonding. Nor is it believed that hydrogen bonding can be adequately taken advantage of in such situations. Many proposals have been made to overcome such difficulties and to improve the bond between such dissimilar synthetic polymeric materials but none has been found to be completely satisfactory to date.

The present invention will be described with particular reference to the bonding of vinyl resins and polyurethane or acrylated polyurethane resins and it is to be appreciated that the principles of the present invention are applicable to all vinyl resins and polyurethane or acrylated polyurethane resins. Similarly, the present invention will be described with specific reference to multi-layered products, such as, for example, resilient floor coverings utilizing these dissimilar synthetic polymeric materials but again, it is to be appreciated that the principles of the present invention are equally applicable to other multi-layered products which also utilize such dissimilar synthetic polymeric materials.

In the manufacture of resilient floor coverings, normally a relatively flat base layer or substrate is laid out in substantially horizontal condition. Such a base layer or substrate is customarily a felted or matted fibrous sheet of overlapping, intertwined fibers and/or filaments, usually of asbestos or of natural, synthetic or man-made cellulosic origin, although many other forms of sheets and films or textile materials or fabrics may be used.

Upon this substantially flat, horizontal base layer or substrate is then applied a substantially uniform base layer of a liquid or semi-liquid resinous composition which contains a synthetic polymeric material, usually an ungelled polyvinyl chloride plastisol, usually containing a blowing or foaming agent. This liquid or semi-liquid plastisol composition is subsequently gelled at an elevated temperature to a relatively firm condition by procedures which are conventional and well known in the art. This relatively firm, gelled plastisol may then be printed with a decorative multi-colored pattern or design in which certain predetermined areas contain a blowing or foaming inhibitor which subsequently modifies the action of the blowing or foaming agent in those certain predetermined area. Several different printing ink compositions may be used.

A substantially uniform wear layer usually of a clear liquid or semi-liquid resinous composition and usually containing another ungelled polyvinyl chloride plastisol composition but generally not containing any blowing or foaming agent is then applied as a wear resistant coating to the surface of the base layer of printed, firmed and gelled polyvinyl chloride plastisol and is subsequently firmed and gelled thereon, either as a separate operation or in a joint operation with a subsequent fusing and blowing and foaming operation of the base layer of polyvinyl chloride plastisol. Thus far, there is relatively very little difficulty in creating a strong, permanent bond or adhesion between the base layer of polyvinyl chloride plastisol and the wear layer, which is also a polyvinyl chloride plastisol.

It is then frequently desired to provide a top surface coating to the surface of the polyvinyl chloride wear layer and it is often desired that such top surface coating be a polyurethane or acrylated polyurethane resin, primarily because of their superior physical and chemical properties and characteristics. However, in many instances, it is found that the adhesion or bond between the vinyl resin wear layer and the polyurethane or acrylated polyurethane resin top surface coating is not as strong or as permanent, as desired or required. It is believed that such lack of strength and of permanency or lack of suitable resistance to delamination is due to the fact that the wear layer and the top surface coating are dissimilar synthetic polymeric materials.

PURPOSES AND OBJECTIVES OF THE INVENTION

It is therefore a principal purpose and objective of the present invention to provide a method of improving the bond between a vinyl resin material and a polyurethane or acrylated polyurethane resin material, whereby a strong, permanent bond is created between such materials which will resist delamination very well.

BRIEF SUMMARY OF THE INVENTION

It has been found that such principal purpose and object, as well as other principal purposes and objects which will become clear from a further reading and understanding of this disclosure, may be achieved by forming a fused layer comprising a vinyl resin and one or more plasticizers for the vinyl resin, treating the surface of the layer with aqueous acetic acid and after removal of the aqueous acetic acid, coating the vinyl resin layer with polyurethane or acrylated polyurethane and exposing the coated vinyl resin layer to curing conditions whereby there is sufficient chemical interaction between the vinyl resin layer and the polyurethane or acrylated polyurethane resin as to provide a strong and permanent bond there between, well capable of resisting delamination.

Figure 2:
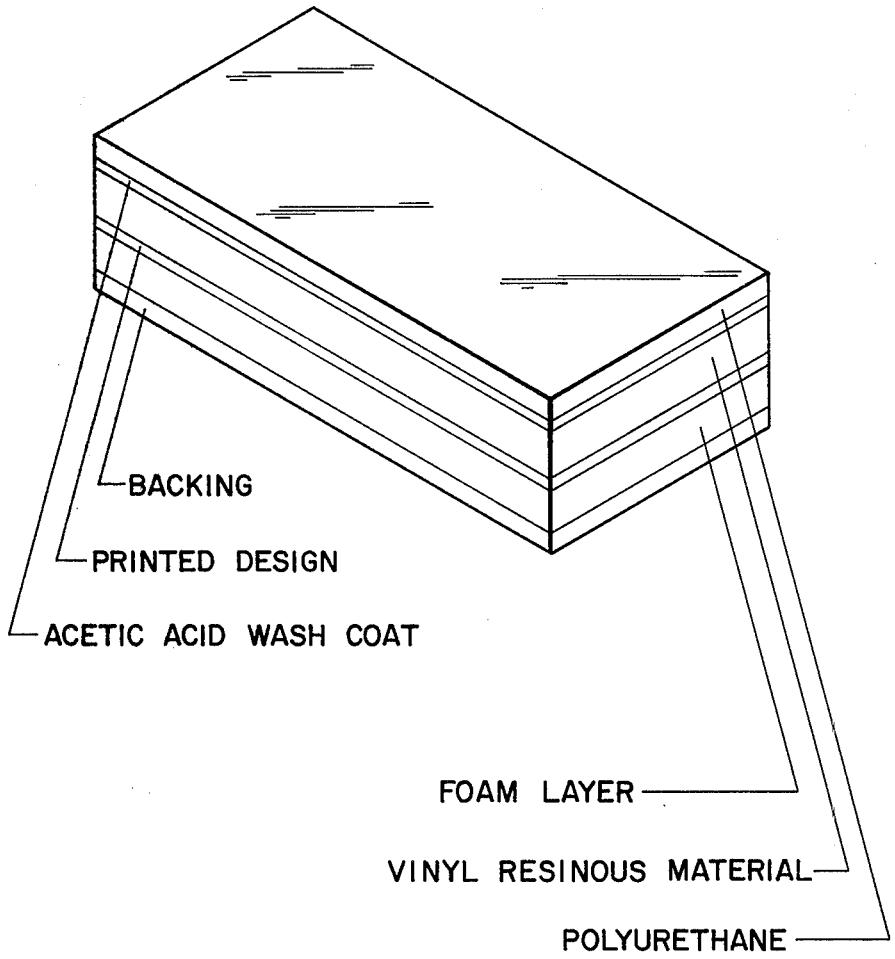

The invention will be better understood from the following detailed description thereof together with the accompanying self-explanatory drawings in which FIG. 1 is a flow diagram of a typical embodiment of the process utilized in this invention and FIG. 2 is an enlarged cross-sectional view of a typical product.

DESCRIPTION OF PREFERRED AND TYPICAL EMBODIMENTS

The Base Layer or Substrate

The specific base layer or substrate which is used to illustrate the preferred and typical embodiments of the present invention does not relate to the essence of the inventive concept and no specific or detailed description thereof is deemed necessary. It is customarily and conventionally a felted or matted fibrous sheet of overlapping, intermingled fibers and/or filaments, usually of asbestos or of cellulosic origin, although many other forms of sheet, films, or fabrics, and many other fibers and/or filaments may be used, such as described in U.S. Pat. Nos. 3,293,094 and 3,293,108 to Nairn et al.

The Base Synthetic Polymeric Layer

A foamable resinous composition is applied to the substrate in a uniform thickness. This foamable composition is preferably a dispersion of resin in a liquid medium. The dispersion medium can be water in the case of an aqueous latex, organic solvent as an organosol or plasticizer as a plastisol. Best results have been obtained with a dispersion of resin in a plasticizer which is conventionally termed a plastisol. A plastisol has appreciable fluidity at normal room temperature, but is converted by heat into a fused, flexible, rough thermoplastic mass. Plastisols are preferred since it is unnecessary to remove large volumes of carrier as is necessary with a latex or organisol.

The preferred and most widely used resin for surface coverings are polymers of vinyl chloride. The vinyl chloride polymers can either be simple, unmixed homopolymers of vinyl chloride or copolymers, terpolymers or the like thereof in which the essential polymeric structure of polyvinyl chloride is interspersed at intervals with the residue of other ethylenically unsaturated compounds polymerized therewith. The essential properties of the polymeric structure of polyvinyl chloride will be retained if not more than about 40 percent of the extraneous comonomer is copolymerized therein. Suitable extraneous comonomers include, for instance, vinyl bromide, vinyl fluoride, vinyl esters, vinyl ethers, cyclic unsaturated compounds such as styrene, acrylic acid and its derivatives, unsaturated hydrocarbons such as ethylene, propylene, isobutene and the like; allyl compounds such as allyl acetate, allyl chloride, allyl ethyl ether and the like; and conjugated and cross-conjugated ethylenically unsaturated compounds such as butadiene, isoprene, chloroprene, 2,3-dimethylbutadiene-1,3-piperylene, divinyl ketone and the like. Although such vinyl chloride resins are preferred, as is apparent, the compositions can be formed from any resin which can be foamed with a blowing agent. Other resins which can be mentioned, however, are polyethylene; polypropylene; methacrylates; synthetic rubber, such as neoprene, silicone, SBR and nitrile; polyurethanes; polyamides; polystyrene; phenolics, urea-formaldehydes; cellulose esters; epoxides and silicones.

In the formulation of plastisol compositions for use in the invention, the fine particle size resin is uniformly dispersed in a mass of fluid plasticizer. The fluidity of plastisols is influenced in part by the particular resin and plasticizers selected, but is also a function of the ratio of plasticizer to resin. Plastisols become less fluid as the ratio of plasticizer to resin is reduced. Coating compositions for use in the invention preferably contain from about 20 to about 150 parts plasticizer per 100 parts resin with a range of about 50 to about 80 parts plasticizer per 100 parts resin being particularly effective. The viscosity of plastisol compositions can also be reduced by addition of small amount of a volatile diluent not exceeding about 10 parts per 100 parts resin; it being required that the diluent have no solvating effect on the resin. Useful diluents include benzene, toluene, methyl ethyl ketone, petroleum solvents such as V.M. and P. naphtha (boiling range of 190°–275° F.) and the like.

The selection of the plasticizer is important in determining the strength and flexibility of the coating and also in influencing the viscosity and viscosity stability of the composition and the foaming characteristics of the foamable composition. Esters of straight and branched chain alcohols with aliphatic acids impart low viscosity and good viscosity stability. Typical plasticizers of this type include dibutyl sebacate, dioctyl sebacate, dioctyl adipate, didecyl adipate, dioctyl azelate, triethylene glycol di (2-ethylhexanoate), diethylene glycol diperlargonate, triethylene glycol dicaprylate, 2,2,4-trimethyl-1,3-pentanediol diisobutyrate, and the like. Plasticizers of the aromatic type, such as esters of aliphatic alcohols and aromatic acids or aromatic alcohols and aliphatic acids or aromatic alcohols and aromatic acids are desirable in that they impart good foaming characteristics to a plastisol, although the use of highly aromatic plasticizers is limited by their tendency to yield plastisols of high viscosity. Typical plasticizers of this type include dibutyl phthalate, dicapryl phthalate, dioctyl phthalate, dibutoxy ethyl phthalate, dipropylene glycol dibenzoate, butyl benzyl sebacate, butyl benzyl phthalate, dibenzyl sebacate, dibenzyl phthalate and the like. Other types of plasticizers, such as esters of inorganic acids, including tricresyl phosphate, octyl diphenyl phosphate and the like, alkyd derivatives of rosin, chlorinated paraffine, high molecular weight hydrocarbon condensates and the like can also be used. The plasticizer or blend of plasticizers is chosen to yield a composition of the desired viscosity and/or foaming characteristics. In addition, the plasticizer should preferably have a low vapor pressure at the temperatures required to fuse the resin. A vapor pressure of 2 millimeters of mercury or less at 400° F. has been found particularly satisfactory.

Small amounts of stabilizers, well known in the art of making polyvinyl chloride compositions, are incorporated in the coating composition to minimize the effects of degradation by light and heat. Primary stabilizers ordinarily used are metallo-organic compounds, salts or complexes containing a metal component such as cadmium, zinc, lead, tin, barium or calcium combined with an anion constituent such as octaoate, 2-ethylhexoate, naphthenate, tallate, benzoate, oxide, acetate, stearate, phenate, laurate, caprylate, phosphite, phthalate, maleate, fumarate, carbonate, sulfate, silicate alkyl mercaptide, or mercaptoacid salts and esters. Mixtures containing one or more metals and/or one or more anion components are commonly employed. Depending upon the degree of heat and light stability required, secondary or auxiliary stabilizers such as expoxidized components, organic phosphites and phosphates, polyhydric alcohols, ultra violet light absorbers, optical brighteners, nitrogen compounds and antioxidants may also be incorporated in the resinous composition.

The coating compositions can contain pigments in accordance with the particular color desired. Any of the organic and inorganic pigments well known in the art for plastic compositions can be used. Normally, from about 0.5 to about 5 parts pigments per 100 parts resin are used.

The foamable compositions contain, in addition, an effective amount of blowing agent. The larger the amount of blowing agent within practical limits used, the greater is the expansion of the foam. Foam densities of from 12 to about 40 pounds per cubic foot can readily be obtained. Such results are attainable with from about 1 to about 20 parts blowing agent per 100 parts resin. About 2 to 10 parts blowing agent per 100 parts resin is particularly effective for the production of foams of a density which are most desirable for use in producing floor coverings in accordance with the invention.

Blowing agents are well known in the art and the particular blowing agent selected usually depends on such matters as cost, resin and density desired. While many compounds decompose by giving off a gas, only a relatively few are produced commercially in quantity. Complex organic compounds which, when heated, decompose to yield an inert gas and have residues which are compatible with the resin are preferred as blowing agents. Such materials have the property of decomposition over a narrow temperature range which is particularly desirable to obtain a good foam structure.

Typical types of blowing agent which can be mentioned include substituted nitroso compounds $$(R-\underset{\underset{NO}{|}}{N}-R')$$

substituted hydrazides ($RSO_2NHNHR'$), substituted azo compounds ($R-N=N-R'$), acid azides ($R-CON_3$), guanyl compounds $$(NH=\underset{\underset{R}{|}}{C}-NH_2)$$

and the like wherein R and R' are hydrogen or hydrocarbon groups usually containing from one to ten carbon atoms.

The blowing agents which have found the most widespread uses are those compounds having the $>N-N<$ or $N=N-$ linkages which decompose at elevated temperatures to yield an inert gas high in nitrogen. These compounds have the general formula

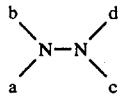

and $a-N=N-b$ wherein a,b,c and d are hydrocarbon groups preferably containing up to ten carbon atoms, or hydrogen with at least one of the groups being a hydrocarbon group. Many of these hydrocarbon groups contain additional nitrogen groups such as hydrazide, amido, nitro, nitrile and the like. The presence of such groups is also desirable since they can readily react with the inhibitor to form derivatives having different decomposition temperatures.

Additional blowing agents which can be mentioned are N, N' dinitrosopentamethylenetetramine, aminoguanidine bicarbonate, p,p'-thiobis (benzene sulphonhydrazide) p,p'-diphenylmethane disulphonohydrazide, benzene sulphonhydrazide, terephthalazide, benzazide, p-tert.-butyl benzazide, phthalazide, isophthalazide, 1,3-diphenyltriazene, azohexahydrobenzonitrile, azo dicarboxylic acid diethyl ester, naphthalene-1,5-disulfonyl hydrazide and biuret.

Blowing agents for use in the invention must be decomposed an effective amount at a temperature below the decomposition temperature of the resin used. The preferred blowing agents are those that decompose above the elastomeric point of the resin composition since this enables at least partial gelling of the foamable coating so that a design can readily be printed on its surface. Such blowing agent usually decomposes above 200° F. As an illustration, with the preferred vinyl chloride polymers, a blowing agent decomposing between about 300° F. and about 450° F. can be used. The minimum initial decomposition temperature must be sufficiently high to prevent premature gas evolution occurring during processing. In some instances, a combination of blowing agents can be used to advantage.

The foamable composition is formed into a film of the desired thickness and then heated to gel the composition to give a good printing surface. In this specification and claims, the term "gel" includes both the partial (at least the elastomeric point) and complete solvation of the resin or resins with the plasticizer (fused). The heating is limited as to the time and temperature to prevent the decomposition of the blowing agent in the composition. When using the preferred polyvinyl chloride composition, the temperature of the composition is preferably raised to about 240° F. to about 275° F. Generally, the actual oven temperature would be a slightly higher temperature. If the foamable composition is to be formed into a self-supporting film, then the temperature would conventionally be high enough to fuse the composition.

A design is printed on the gelled surface of the foamable composition using any of the conventional printing techniques such as silk screen, offset or direct rotogravure printing. If desired, an inhibitor can be added to one or more of the inks. Such inks usually contain a carrier for the pigment, such as a vinyl resin, and, in some cases, a plasticizer for the resin to give good adhesion to the printing surface.

The inhibitor for the blowing agent is an agent which significantly alters the decomposition temperature of the blowing agent in the area of the foamable composition below where it is deposited. By varying the concentration of the inhibitor, the degree of suppression or acceleration of the decomposition of the blowing agent can be controlled to produce foam layers of various heights or thicknesses.

The chemical composition of the blowing agents varies widely and, therefore, the type of compound utilized as an inhibitor will vary. Compounds which have been found to be effective as inhibitors to alter the decomposition temperatures for blowing agents which contains the $-N=N-$ or $N-N$ linkages are the following groups:

(1) Organic acids, and particularly such as maleic, fumaric, adipic, malic, citric, salicylic, trimellitic, pyromellitic, malonic, and the like. As a general rule, the most useful acids are those having at least two carboxyl group and one hydroxy group and which contain from 2 to 12 carbon atoms.

(2) Organic acid halides preferably which contain from 2 to 20 carbon atoms and particularly the chlorides such as trimetallic anhydride monoacic chloride, stearoyl chloride, phthaloyl chloride, benzoyl chloride, palmitoyl chloride, cinnamoyl chloride, fumaryl chloride and the like.

(3) Organic acid anhydrides preferably those containing from 2 to 20 carbon atoms such as maleic, phthalic, succinic, pyromellitic dianhydride, citraconic, pyrotartaric, dodecenyl succinic, trimellitic and the like.

(4) Polyhydroxy alcohols. The polyhydroxyl aromatic compounds, which form a useful sub-class of alcohols, preferably contain two functional groups, and from 2 to 20 carbon atoms. Representative compounds include p-aminophenol, catechol, resorcinol, hydroquinone, pyrogallol, phloroglucinol and the like. Aliphatic alcohols which can be used preferably contain at least two hydroxy groups and include mannitol, sorbitol, glycerol, ethylene glycol and diethylene glycol.

(5) Carbohydrates, such as d-maltose, d-galactose, d-glucose and fructose.

(6) Nitrogen containing compounds as amines, amides, oximes, and the like, such as ethanolamine, cyclohexylamine, benzylamine, piperazine, p-nitroaniline and the like. The amine is preferably a primary or secondary aliphatic mono- or polyamine. The aliphatic portion may contain an aromatic or cyclic grouping and be saturated or unsaturated. Cyclic compounds can, for example, have a 6 to 10 member ring and can have from 3 to 12 carbon atoms. Certain of the tertiary aliphatic amines also are useful amines.

(7) Sulphur containing compounds such as thiols or mercaptans, sulfides, sulfones, sulfoxides, sulfonic acids, sulfonyl chloride, sulfonamides, sulfimides and the like.

(8) Isocyanates such as 2,4-tolyene diisocyanate, p,p'-diphenylmethane diisocyanate, bitolyene diisocyanate, methylene bis (4-phenylisocyanate), dianisidine diisocyanate, phenyl isocyanate and the like.

(9) Ketones and aldehydes such as cyclohexanone, acetylacetone, 1,3-diphenyl-1,3-propanedione, 1-phenyl-1, 3-butanedione, glyoxal. Preferred compounds within this class will contain two functional groups, i.e., polyketones or polyaldehydes.

(10) Phosphate and phosphite compounds such as n-butyl acid phosphate, diamyl amyl phosphate, trilauryl trithiophosphite, and phenylneopentyl phosphite.

(11) Other interesting compounds which exert inhibiting qualities are 6,6-dimethyl fulvene, hexachlorocyclopentadiene, 2,4-dinitrophenol, n-hexyl chloroformate, p-nitrobenzyl chloroformate, dibutyl tin maleate and positive chlorine compounds such as dichloroisocyanurate, N-chloro-p-benzoquinone imine, dichloroamine, and halene. Some of these latter compounds are contained in the above groups.

The inhibitor produces a differential in the amount of expansion of the contacted areas as compared to the other areas when the heating of the composition is controlled to permit the differential expansion. This results from a lowering or raising of the decomposition temperature of the contacted blowing agent. The portions of the resinous composition layer on which inhibitor is applied will be higher or lower, because of this differential decomposition of the blowing agent. The chemical mechanism involved is not known, but it is believed the inhibitor reacts with the functional group or groups on the blowing agent to form a compound or complex having a decomposition temperature different from the blowing agent itself.

The Wear Layer

An overall clear resinous wear layer is applied to the printed, gelled foamable composition. The wear layer is comprised of resins, plasticizers and stabilizers such as those mentioned above in the discussion of the synthetic polymeric layer. The wear layer can be a preformed, self-supporting, non-fused sheet of resinous composition of from about 0.014 inch to about 0.050 inch. This type of wear layer is applied to the product prior to the final heating so that during the final heating both the wear layer and the foamable composition are fused and bonded and the wear layer conforms to the surface embossings of the blown foamable composition. Alternately, a layer of clear plastisol can be applied to the unfused surface of the product, so that when the product is fused, the resin in the plastisol becomes completely solvated with plasticizer to form a solid, durable layer that conforms to the surface embossings of the fused product.

The entire assembly comprising the foamable resinous composition and the wear layer is then heated to a temperature sufficient to fuse the resinous compositions and decompose the blowing system. The temperature of the entire mass of composition upon the backing must attain the fusion temperature of the resin in order to obtain a product of maximum strength and stain resistance. Using the preferred vinyl resin, fusion is attained at a temperature of about 325° F. to about 375° F. In addition, the entire mass of foamable composition must be heated to a point where the blowing agent is decomposed. When the preferred high temperature blowing agent is used, foaming does not occur until the resinous composition has been fused. The heating must be carried out, however, at a temperature which allows decomposition of the blowing agent only in the areas desired.

The Aqueous Acetic Acid Treatment

The cooled surface of the fused vinyl resin wear layer is washed with aqueous acetic acid and then dried just prior to the polyurethane coating and subsequent cure. The acetic acid has a strength in the range of from about 1.5% to about 4% and preferably from about 2% to about 2.5% in aqueous solution. The aqueous acetic acid may simply be flooded over the fused vinyl surface and air knifed off, or any other suitable means for applying and then removing the acetic acid solution may be employed. The aqueous acetic acid should remain in contact with the vinyl layer from about 0.5 second to about 120 seconds and preferably from about 2 seconds to about 10 seconds.

The Top Coating

The specific polyurethane or acrylated polyurethane resin which is used in the formulation of the top surface coating which is to be applied to or formed on the vinyl resin wear layer does not relate to the essence of the present invention. The polyurethane may be a conventional polyurethane resin, or it may be a modified or acrylated polyurethane resin.

Conventional polyurethane resins are reaction products of the polymerization reaction between one or more polyols and one or more polyisocyanates. The particular proportions of the polyols and the polyisocyanates do not relate to the essence of the present invention but, normally, the NCO/OH ratio is in the stoichiometric range of from about 1/1, or 1.01/1 which represents an excess of NCO, up to a stoichiometric ratio of about 2:1, with preferred ranges of from about 1.2:1 to about 1.7:1.

The polyhydroxy compounds or polyols may be selected from a very wide variety of diols, triols, tetrols, or various other polyols, or mixtures thereof, from various sources.

The Diols

The diols used in carrying out the principles of the present inventive concept may be selected from a large group of diols or glycols, or derivatives thereof, such as polyether diols, polyester diols, etc. Illustrative of such suitable diols but not limitive thereof are the following:

ethylene glycol
diethylene glycol
triethylene glycol
tetraethylene glycol
pentaethylene glycol
propylene glycol
trimethylene glycol
tetramethylene glycol
pentamethylene glycol
hexamethylene glycol
neopentyl glycol The polyether glycols are condensation products of one or more of the above-identified glycols, or mixtures thereof, with an alkylene oxide having from 2 to 5 carbon atoms, such as ethylene oxide, propylene oxide, trimethylene oxide, 1,2-butylene oxide, isobutylene oxide, 1,4-tetramethylene oxide, pentamethylene oxide, or mixtures thereof. Also of use are the polyester glycols which are condensation products of one or more of the above-identified glycols, or mixtures thereof, with various saturated or unsaturated, aliphatic or aromatic dibasic acids, or mixtures of such acids.

The Triols

The triols or trihydroxy-containing compounds used in carrying out the principles of the present inventive concept may be selected from a large group of triols, or derivatives, or condensation products thereof, such as polyether triols, polyester triols, etc. Illustrative but not limitative of such triols are the following:

glycerol
1,1,1-trimethylol propane
1,1,1-trimethylol ethane
1,2,3-butanetriol
1,2,4-butanetriol
1,2,3-pentanetriol
1,2,3-hexanetriol
1,2,4-hexanetriol
1,2,5-hexanetriol
1,2,6-hexanetriol
2,3,4-hexanetriol
1,3,6-hexanetriol The derivatives and the condensation products of such triols are formed by chemical procedures analogous to the chemical procedures used in deriving analogous derivatives and condensation products of the diols, as described previously.

The Tetrols

The tetrols or tetrahydroxy-containing compounds used in carrying out the principles of the present inventive concept may be selected from the following polyols, or derivatives thereof, or condensation products thereof, as previously described. These polyols are, of course, illustrative but not limitative.

erythritol
pentaerylthritol

Other Polyols

Polyols of higher functionality than four are also generally of use in the application of the principles of the present inventive concept. Polyhydroxy-containing compounds including pentols, such as adonitol and arabitol, for example, and hexitols, such as dulcitol, mannitol and sorbitol, for example, are also of use. These, of course, may be used as is, or in the form of derivatives thereof, or condensation products thereof with various alkylene oxides, as previously described herein. "RUCOFLEX" (Hooker) R-102, a highly branched low molecular weight of 700, ester polyol, having a hydroxyl number of 400, and a functionality of five is a specific example of such a polyol of higher functionality.

Caprolactone polyols are also generally of application within the broader scope of the present invention. Such caprolactone polyols are based on or derived from hydroxy carboxylic acids and are used as is, or as polymerization products thereof with various alkylene oxides, or as other derivatives thereof. Of particular application are caprolactone polyols PCP-0300 and PCP-0301 (Union Carbide) which are liquid caprolactone polyols having low viscosities, are trifunctional, having melting points of 20° or less, with molecular weights between about 300 and 540, and hydroxyl numbers, that is, mg. KOH/g. of between about 560 and 310, respectively.

Other polyhydroxy-containing compounds are also of use within the broader scope of the present inventive concept, provided they are capable of furnishing the necessary hydroxyl for reaction with the isocyanate in the formation of the polyurethane polymer. Typical of such other polyhydroxy-containing compounds are the poly (hydroxyalkyl) derivatives of such compounds as the alkylenepolyamines, or the various polyether polyols with amine. One specific example of such a group is "QUADROL" (BASF-Wyandotte) which is N,N,N',N'-tetra-kis (2-hydroxypropyl) ethylenediamine, a colorless viscous liquid having a functionality of four, a molecular weight of 292, a hydroxyl number of 770, and a boiling point of 190° C. (1 mm).

The Polyisocyanates

The polyisocyanates used in carrying out the principles of the present invention are selected from a large group of aliphatic, aromatic, cycloaliphatic, and heterocyclic polyisocyanates. They include the following, which are illustrative but not limitative.

4,4'-methylene-bis-cyclohexyl diisocyanate
hexamethylene-1,6-diisocyanate
tetramethylene-1,4-diisocyanate
cyclohexane-1,4-diisocyanate
1,4-cyclohexylene diisocyanate 2,2,4-trimethyl-1,6-hexane diisocyanate
trimethyl hexamethylene diisocyanate
dimer acid diisocyanate
trimer of hexamethylene diisocyanate
ethylene diisocyanate
ethylidene diisocyanate
2,4-tolylene diisocyanate
2,6-tolylene diisocyanate
p-phenylene diisocyanate
m-phenylene diisocyanate
4,4'-methylene bis (phenylisocyanate)

naphthylene-1,5-diisocyanate
4,4'-biphenylene diisocyanate
furfurylidene diisocyanate
butane-1,4-diisocyanate
isophorone diisocyanate Conventional polurethane resins are normally cured by conventional thermal processing in ovens or other suitable heating apparatus at elevated temperatures of from about 150° F. to about 450° F. and preferably from about 260° F. to about 410° F. for a period of time of from about 1 minute to about 8 minutes, and preferably from about 3 minutes to about 5 minutes.

Modified or Acrylated Polyurethanes

Modified polyurethanes, such as acrylated polyurethanes, may be prepared by several different methods, one preferred and typical method using three basic components: (1) a UV reactive polymer; (2) a diluent system composed of multi-functional acrylate esters (and occasionally monofunctional acrylic esters); and (3) a photoinitiator system.

The UV reactive polymer may be initially synthesized, for example, from a conventional isocyanate-function terminated polyurethane by reaction with a hydroxyalkyl acrylate to form an essentially polyurethane structure having terminal acrylate functionality. If desired, the hydroxyalkyl acrylate may be replaced by hydroxyalkyl methacrylates, or by other hydroxy-containing vinyl compounds, such as vinyl esters, vinyl ethers, vinyl sulfides, etc., to yield essentially polyurethane structures having terminal methacrylate functionality or vinyl functionality. The acrylate functionality is normally preferred. Examples of preferred or typical hydroxyalkyl acrylates are: hydroxyethyl acrylate, hydroxymethyl acrylate, hydroxypropyl acrylate, etc. Examples of preferred and typical hydroxyalkyl methacrylates are: hydroxyethyl methacrylate, hydroxymethyl methacrylate, hydroxypropyl methacrylate, etc. Examples of other preferred and typical hydroxy-containing vinyl compounds are: B-hydroxyethyl vinyl ether, B-hydroxyethyl vinyl sulfide, etc.

The diluent system is composed of multifunctional acrylate esters (and occasionally monofunctional acrylic esters) such as: pentaerythritol triacrylate, trimethylolpropane triacrylate, 1,6-hexanediol diacrylate, ethylene glycol dimethacrylate, polyethylene glycol (200) dimethacrylate, pentaerythritol tetraacrylate, 1,3-butylene glycol diacrylate, 1,4-butanediol diacrylate, neopentyl glycol diacrylate, etc. If monofunctional monomers are to be included along with the multifunctional compounds, the following illustrative examples of such monomers may be used: methyl acrylate, ethyl acrylate, butyl acrylate, hexyl acrylate, isobutyl acrylate, benzyl acrylate, cyclohexyl acrylate, 2-ethylhexyl acrylate, butoxyethyl acrylate, isodecyl acrylate, glycidyl acrylate, vinyl acetate, etc., and the corresponding methacrylates.

The photoinitiator may be selected from a large group of known photoinitiators of which the following are illustrative but not limitative: benzoin and its alkyl ethers such as methyl or isobutyl ether of benzoin, benzophenone and its derivatives such as 2,4-dihydroxybenzophenone, 2-hydroxy-4-methoxy benzophenone, used singly or in combination with amine compounds such as dimethylaminoethanol, N,N-dimethylaniline, triphenylphosphine, etc., dimethoxyphenyl acetophonone, diethoxy acetophenone, etc., xanthone, thioxanthone, anthraquinone, flavone, benzil, polycyclic aromatic ketones, etc. Such photoinitiators are used in amounts of from about 0.5% to about 20% by weight, and preferably from about 1% to about 5% by weight, based on the total weight of the ultraviolet curable formulation.

The acrylated polyurethane resin top surface coating may be prepared by other conventional methods well known in the art, such as, for example, those methods disclosed in U.S. Pat. No. 4,100,318. Curing conditions for the modified or acrylated polyurethane resins differs from those employed for the more conventional polyurethane resins, in that modified or acrylated polyurethane resins are cured by passed through an actinic radiation source, such as an ultraviolet lamp unit. Radiation curing by electron beam, gamma and x-ray treatment, and other suitable radiation sources may be employed but must be used at relatively low energy levels, inasmuch as they are essentially examples of very high energy irradiation techniques leading to extremely rapid polymerization. Ultra violet radiation is the preferred and typical source. In the presence of photoinitiators, such radiation sources induce a photochemical reaction which produces free radicals capable of inducing polymerization. Sources of ultraviolet radiation may be mercury vapor arc lamps, plasma arcs, pulsed xenon lamps and carbon arcs. Mercury vapor arc lamps are preferred and typical, preferably at medium pressure rather than high pressure or low pressure. Specific wavelengths of light which are most effective will vary, depending primarily upon the particular polyurethane top coating formulation used and the photo-sensitizer employed. It is also to be appreciated that, in some instances, combinations of thermal curing and radiation curing conditions may be used.

The present invention will be further described with particular reference to the following specific working examples, wherein there are disclosed preferred and typical embodiments of the present invention. However, it is to be pointed out that such specific examples are primarily illustrative and not limitative of the broader principles of the inventive concept and that other specific materials, chemicals, processes, etc., may be employed without departing from the scope and the spirit of the appended claims.

EXAMPLE I

The base layer or substrate comprises a relatively flat, 0.040 inch thick fibrous sheet of felted, matted asbestos fibers with an acrylic resin smoothing and leveling coating thereon. The asbestos fibrous sheet is coated substantially uniformly to a wet thickness depth of about 0.015 inch with the following foamable polyvinyl chloride plastisol composition as the base synthetic polymeric layer:

| | Parts |
|---|---|
| Polyvinyl chloride, low mol. wt. general purpose, dispersion resin, inherent viscosity 0.99 (ASTM 1243-66) | 30.2 |
| Polyvinyl chloride, med. mol. wt. dispersion grade, inherent viscosity 1.0 | 8.2 |
| Polyvinyl chloride, med. mol. wt. blending resin, inherent viscosity 0.9 | 17.1 |
| Anhydrous alumina silicate filler | 6.9 |
| Alkyl benzyl phthalate plasticizers | 24.7 |
| Polydodecyl benzene | 7.4 |
| Azodicarbonamide blowing agent | 1.1 |
| Accelerator/stabilizer | 0.4 |

-continued

| | Parts |
|---|---|
| Titanium dioxide | 2.5 |
| Dioctyl phthalate | 1.5 |
| Wetting agent | 0.03 |
| | (parts by weight) |

Gelling and firming of the potentially foamable polyvinyl chloride plastisol is accomplished in a heated oven atmosphere maintained at an elevated temperature of about 300° F. for a period of time of about 3 minutes. This temperature is not that elevated as to activate or decompose the azodicarbonamide blowing agent in the polyvinyl chloride plastisol base synthetic polymeric layer so as to cause blowing or foaming thereof.

The gelled, firmed potentially foamable polyvinyl chloride plastisol is then printed with a multicolored decorative design or pattern, using (1) a conventional or standard printing ink composition and (2) an inhibitor-containing printing ink composition, having the following compositions, respectively:

| | Parts |
|---|---|
| Solution grade vinyl chloride-vinyl acetate copolymer (90 parts: 10 parts) | 15 |
| Methyl ethyl ketone | 85 |
| Pigment or colorant, as needed or required | |
| Solution grade vinyl chloride-vinyl acetate copolymer (90 parts: 10 parts) | 12 |
| Methyl ethyl ketone | 68 |
| Trimellitic anhydride blowing inhibitor | 20 |
| Pigment or colorant, as needed or required | |

The printed, gelled, potentially foamable polyvinyl chloride plastisol is then allowed to air-dry and a polyvinyl chloride plastisol wear layer is substantially uniformly applied thereto to a wet thickness depth of about 0.015 inch. The wear layer has the following composition by weight:

| | Parts |
|---|---|
| Polyvinyl chloride, dispersion grade, high mol. wt. | 89.4 |
| Polyvinyl chloride, blending resin, inh. vis. 0.9 | 10.6 |
| Butyl benzyl phthalate plasticizer | 28.9 |
| 2,2,4-trimethyl-1,3-pentanediol diisobutyrate | 6.9 |
| Plasticizer (S-587) | 9.3 |
| Epoxy plasticizer (G-62) | 5.0 |
| Ba-Zn stabilizer | 7.0 |
| Toner | 0.21 |
| UV absorber | 0.31 |

Gelling and firming of the applied polyvinyl chloride plastisol wear layer takes place at an elevated temperature in a heated oven at about 300° F. for a period of time of about 3 minutes, followed by a fusing of the polyvinyl chloride layers, and a blowing and a foaming of the base synthetic polymeric layer at an elevated temperature of about 430° F. for a period of time of about one minute and forty seconds.

The fused vinyl wear layer is treated with acetic acid in a tandom operation where a 2% aqueous acetic acid wash coat is flooded over the fused vinyl surface and air knifed off. The acid wash remains on the wear layer for a period of time of about 5 seconds.

The polyvinyl chloride wear layer is then coated substantially uniformly to a wet thickness depth of about 1½ mils with the following acrylated polyurethane top coating composition:

| | Parts |
|---|---|
| Acrylated urethane oligomer | 80 |
| Tetraethylene glycol diacrylate | 10 |
| N-vinyl pyrrolidone | 15 |

To this formulation is added 3% Vicure-10 (isobutyl ether of benzoin) photoinitiator.

The curing of the applied polyurethane resin top coating takes place by passage through an ultraviolet unit having a length of about 3 feet (2 lamp parallel unit, 12 inches long, 200 watts each lamp. medium pressure, mercury lamp) and a nitrogen atmosphere at a rate of about 10 feet per minute.

The bond between the vinyl wear layer and the acrylated polyurethane top surface coating is tested and is found to be strong and permanent and capable of resisting delamination very well.

EXAMPLE II

The procedures described in Example I are followed substantially as set forth therein with the exception that the acrylated polyurethane top coating composition has the following formulation:

| | Grams |
|---|---|
| Acrylated urethane oligomer | 80 |
| Tetraethylene glycol diacrylate | 10 |
| 2-ethylhexyl acrylate | 15 |
| Vicure-10 (isobutyl ether of benzoin) photoinitiator | 3% |

The results of this Example are generally comparable to the results of Example I. The bond between the dissimilar synthetic polymeric materials is strong and permanent. Delamination is found to be resisted successfully.

EXAMPLE III

The procedures described in Example I are followed substantially to set forth therein with the exception that the acrylated polyurethane top coating composition has the following composition:

| | Grams |
|---|---|
| Acrylated urethane oligomer | 80 |
| 1,6-hexanediol diacrylate | 10 |
| 2-ethylhexyl acrylate | 8 |
| Vinyl acetate | 7 |
| Vicure-10 (isobutyl ether of benzoin) photoinitiator | 3% |

The results of this Example are generally comparable to the results of Example I. The bond between the dissimilar synthetic polymeric materials is strong and permanent. Delamination is resisted very well.

EXAMPLE IV

The procedures described in Example I are followed substantially as set forth therein with the added definition that the acrylated urethane oligomer in the top coating composition is derived from Hylene W, methylene-bis-(4-cyclohexylisocyanate), Teracol 650 polytetramethylene ether glycol, and hydroxyethyl methacrylate. The results ae satisfactory and are generally comparable to the results obtained in Example I.

EXAMPLE V

The procedures described in Example I are followed substantially as set forth therein with the added definition that the acrylated urethane oligomer in the top coating composition is derived from Hylene W, methylene-bis-(4-cyclohexylisocyanate), Teracol 650 polytetramethylene ether glycol, and hydroxyethyl acrylate. The results are satisfactory and are generally comparable to the results obtained in Example I.

EXAMPLE VI

The procedures described in Example I are followed substantially as set forth therein with the added definition that the acrylated urethane oligomer in the top coating composition is derived from Hylene W, methylene-bis-(4-cyclohexylisocyanate), propylene glycol, hydroxypropyl acrylate and a minor amount of Plural 450 Terrol polyoxyalkylene polyol based on pentaerythritol.

EXAMPLE VII

The procedures described in Example I are followed substantially as set forth therein with the exception that the acrylated polyurethane top coating composition is replaced by a conventional polyurethane top coating composition wherein the polyurethane is derived from Hylene W, methylene-bis-(4-cyclohexylisocyanate), Teracol 650 polytetramethylene ether glycol and 1,2,3-butanetriol. Curing takes place at an elevated temperature of about 385° F. for 2 minutes and 45 seconds. The results are satisfactory and are generally comparable to the results obtained in Example I.

EXAMPLE VIII

The procedures described in Example I are followed substantially as set forth therein with the exception that the acrylated polyurethane top coating composition is replaced by a conventional polyurethane top coating composition wherein the polyurethane is derived from isophorone diisocyanate (3-isocyanatomethyl-3,5,5-trimethylcyclohexyl isocyanate), Pluracol 650 Tetrol polyoxyalkylene polyol based on pentaerythritol and erythritol. Curing takes place at about 385° F. for 2 minutes and 45 seconds. The results are satisfactory and are generally comparable to the results obtained in Example I.

EXAMPLE IX

The procedures described in Example IV are followed substantially as set forth therein with the exception that the Hylene W, methylene-bis-(4-cyclohexylisocyanate) in the top coating formulation is replaced by trimethyl hexamethylene diisocyanate. The results are satisfactory and are generally comparable to the results obtained in Example IV.

Although several specific working Examples of the inventive concept have been described in particularity, the same should not be construed as limitative of the invention but as merely illustrating specific materials and procedures which are preferred and typical. Other materials and procedures may be used, as well as other equivalent features and aspects, without departing from the scope and the spirit of the appended claims.

What is claimed is:

1. A method of improving the bond between a layer of vinyl resinous material and a layer of a resinous composition solution from the group consisting of polyurethane and acrylated polyurethane resin materials which comprises coating a fused vinyl resinous layer with an aqueous acetic acid solution, drying the aqueous coating, applying an uncured polyurethane or acrylated polyurethane layer to the coated surface of the vinyl resin material and exposing the vinyl resinous composition layer and the uncured polyurethane or acrylated polyurethane resin layer to curing conditions to develop a strong and permanent bond between the two layers.

2. The process of claim 1 wherein said vinyl resinous composition layer is polyvinyl chloride composition.

3. The process of claim 1 wherein said polyurethane is a reaction product of methylene-bis (4-cyclohexylisocyanate), polytetramethylene ether glycol and 1,2,3-butanetriol.

4. The process of claim 1 wherein said polyurethane is a reaction product of trimethyl hexamethylene diisocyanate, polytetramethylene ether glycol and hydroxyethyl methacrylate.

5. The process of claim 1 wherein said polyurethane is a reaction product of isophorone diisocyanate, a tetrol polyoxyalkylene polyol based on pentaerythritol and erythritol.

6. The process of claim 1 wherein a polyurethane resin material is used and curing conditions take place at elevated temperatures of from about 260° F. to about 410° F. for a period of time from about 1 minute to about 8 minutes.

7. The process of claim 1 wherein an acrylated polyurethane resin material is used and curing conditions take place by means of radiation curing.

8. The process of claim 1 wherein an acrylated polyurethane resin material is used and curing conditions take place by means of mercury vapor arc radiation curing.

* * * * *